US005474097A

United States Patent [19]

Lowe et al.

[11] Patent Number: 5,474,097

[45] Date of Patent: Dec. 12, 1995

[54] SCALE REMOVAL AND DISPOSAL SYSTEM AND METHOD

[75] Inventors: David J. Lowe, Anchorage, Ak.; Alan McArthur, Sacramento, Calif.; Mark A. Major, Eagle River, Ak.

[73] Assignees: Atlantic Richfield Company, Los Angeles, Calif.; The Standard Oil Company, Cleveland, Ohio

[21] Appl. No.: 150,523

[22] Filed: Nov. 10, 1993

[51] Int. Cl.[6] ..... B08B 9/02

[52] U.S. Cl. ..... 134/104.4; 134/104.2; 134/115 G; 134/167 C; 134/181; 122/392

[58] Field of Search ..... 134/105, 104.2, 134/104.4, 115 G, 133, 153, 159, 170, 171, 172, 167 C, 181; 15/104.075, 104.13, 104.15, 104.16, 105, 104, 337; 122/390, 391, 392, 387

[56] References Cited

U.S. PATENT DOCUMENTS

| | | | |
|---|---|---|---|
| 2,306,926 | 12/1942 | Allen | 134/167 R |
| 2,967,316 | 1/1961 | Kandle | 15/104.095 |
| 3,354,490 | 11/1967 | Masters et al. | 15/104.095 |
| 3,688,782 | 9/1972 | Smith | 134/170 |
| 4,095,305 | 6/1978 | Goodwin | 134/167 C |
| 4,166,301 | 9/1979 | Smith | 15/104.095 |
| 4,173,493 | 11/1979 | Kallas | 134/104.4 |
| 4,390,034 | 6/1983 | Bes | 134/167 C |
| 4,460,005 | 7/1984 | Rodger | 134/104.4 |
| 4,509,544 | 4/1985 | Mains, Jr. | 134/167 C |
| 4,715,324 | 12/1987 | Muller et al. | 134/172 |
| 4,763,376 | 8/1988 | Spurlock, Jr. et al. | 15/104.13 |
| 5,122,193 | 6/1992 | Derlein | 134/167 C |

FOREIGN PATENT DOCUMENTS

| | | | |
|---|---|---|---|
| 565726 | 7/1977 | U.S.S.R. | 134/184 |

OTHER PUBLICATIONS

EP 32,813 Jul. 1981.

*Primary Examiner*—Frankie L. Stinson
*Attorney, Agent, or Firm*—Michael E. Martin

[57] ABSTRACT

A pipe and tube cleaning system, particularly useful for cleaning scale from pipes and tubes used in oil and gas production operations and containing naturally occurring radioactive materials in the scale, includes an elongated closable tub for supporting a section of pipe or tube for combined hydraulic jet blast and mechanical cutting and cleaning action by a lance insertable within the pipe to remove scale from the interior of the pipe. A slurry of particulate material removed from the pipe and the cleaning liquid (water) is collected in the tub and discharged to a particle size reduction and filtering system which reduces the particle size of the material to form a slurry of very fine particles which may be disposed of through an injection well. Some of the slurry may be returned to the system for use as cleaning liquid. Pipe is loaded into and removed from the tub by a pipe handling mechanism including retractable supports with ramp surfaces which position the pipe for movement into and out of the tub. The system provides for cleaning tube and pipe sections while minimizing exposure of the material removed from the tube and pipe sections to the environment except through suitable disposal means such as an injection well.

21 Claims, 3 Drawing Sheets

SCALE REMOVAL AND DISPOSAL SYSTEM AND METHOD

BACKGROUND OF THE INVENTION

1. Field of the Invention

The present invention pertains to a scale and debris removal and disposal system for cleaning well tubulars and similar pipe elements to remove mineral scale, including naturally occurring radioactive materials, and other debris and preparation of the material of the removal process for disposal such as by injection into a subterranean earth formation through a disposal well.

2. Background

In the operation and maintenance of oil and gas fields, it is often necessary to clean well tubes and pipes to remove the residue of the production of oil and gas and of certain fluids used in stimulating the production of subterranean fluids, such as tubes and pipes used in water flood or produced water processing and treatment systems. Many applications of oil field tubes and pipes as well as other tube and pipe elements result in the eventual build-up of mineral scale on the pipe interior and exterior surfaces.

In certain operations, such as the production of oil and gas, the mineral scale which has accumulated on tube and pipe surfaces may include naturally occurring radioactive materials (NORM). Although the intensity of radiation resulting from such scale build-up in tubes and pipes is generally considered non-hazardous, it is desirable to minimize contamination resulting from cleaning pipes and tubes which have mineral scale which includes naturally occurring radioactive materials. Since the cleaning operation and the processing of the residue or debris results in a concentration of NORM, it is even more important to minimize or prevent uncontrolled spreading and deposition of the cleaning fluid and the debris, including scale, which results from the cleaning and handling processes. The present invention has been developed with this problem in mind to provide a solution which results in a unique cleaning and disposal system and method for cleaning tubes and pipes, particularly those used in oil and gas field applications.

SUMMARY OF THE INVENTION

The present invention provides a system for cleaning mineral scale and other debris from both the inside and outside surfaces of tube and pipe elements. The system of the invention is particularly adapted for containing the cleaning fluid, such as water, and the scale and other debris cleaned from the tubes or pipes and for conducting the cleaning fluid and solids debris material to a processing system which prepares the material for disposal such as by injection into a subterranean earth formation.

In accordance with an important aspect of the invention, an apparatus is provided for high-pressure liquid blast cleaning of scale and other contaminants from both the inside and outside surfaces of tube and pipe members, particularly those used in oil and gas field operations and wherein the spent cleaning liquid and the material removed from the tubes or pipes is substantially prevented from contact with operating personnel or the environment. The system also includes means for reducing the particle size of the solids material in the debris and preparation of the debris material and at least some of the cleaning liquid for injection into the earth through a disposal well.

The system of the present invention is particularly adapted to provide containment of a washing liquid and the material removed from tubes or pipes and for effective processing of the material to reduce its particle size to form a fine particle slurry which may be easily conducted to and pumped into a disposal well. The system is adapted for easy transport into remote areas such as remotely disposed oil and gas production fields, for using a limited quantity of cleaning liquid, such as water, and for efficient reduction of the particle size of the solids material to prepare it for injection into a disposal well.

Still further in accordance with the invention, the cleaning system includes a unique pipe handling mechanism and a combination high-pressure liquid jet blast and mechanical cleaning head and drive lance arrangement which facilitates removal of scale which is particularly hard and fast on the interior surfaces of tube and pipe elements.

Those skilled in the art will recognize the above-described features and advantages of the invention together with other superior aspects thereof upon reading the detailed description which follows in conjunction with the drawing.

DESCRIPTION OF PREFERRED EMBODIMENTS

Figure 1:
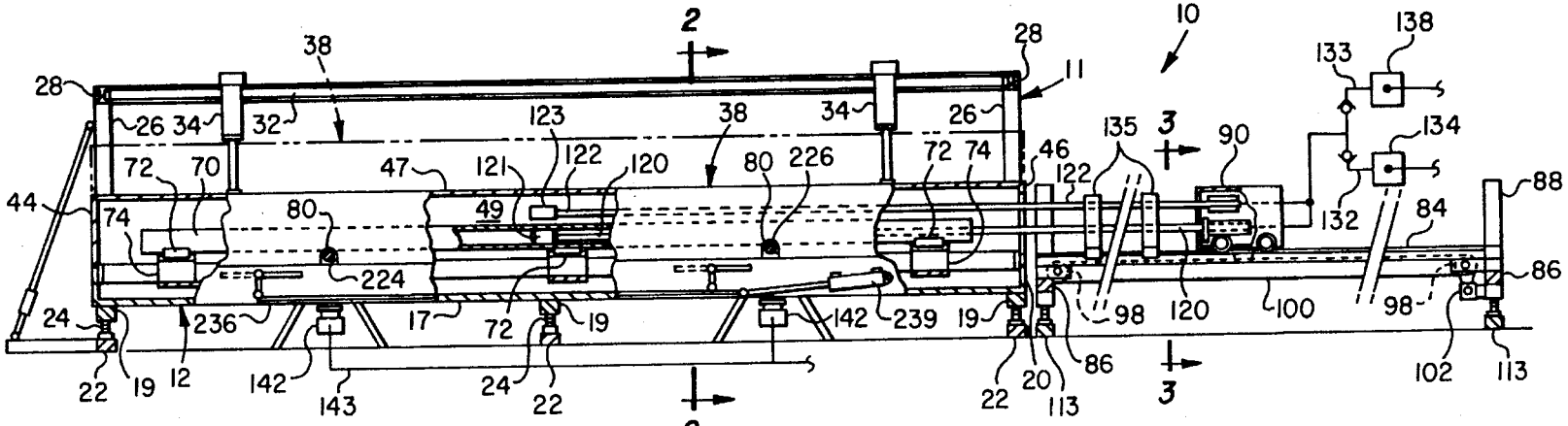
FIG. 1 is a longitudinal side elevation, partially sectioned, of the cleaning and disposal system of the present invention.

In the description which follows, like parts are marked throughout the specification and drawing with the same reference numerals, respectively. The drawing figures are not necessarily to scale in the interest of clarity and conciseness.

Figure 2:
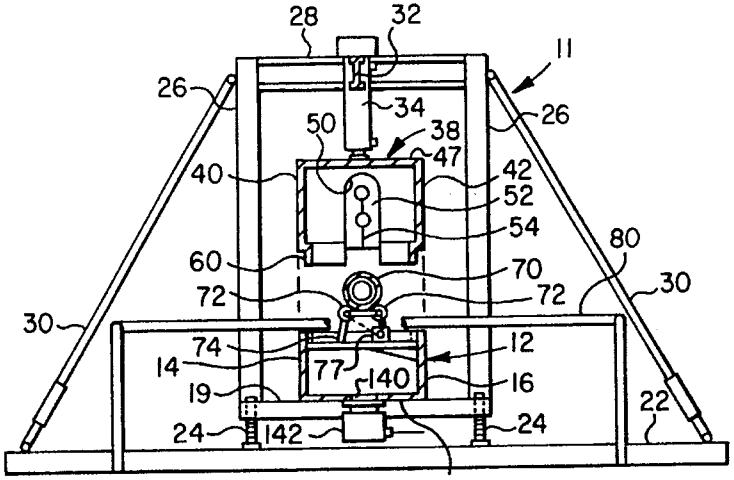
FIG. 2 is a section view taken generally from the line 2—2 of FIG. 1.

Referring to FIGS. 1 and 2, there is illustrated a major part of a system 10 particularly adapted for cleaning the exterior and interior surfaces of tubes and pipes, particularly of the type used in oil and gas production and distribution systems. Tube and pipe used in oil and gas well operations may become coated with scale comprising certain materials, such as barium sulfate, which also incorporate small amounts of naturally occurring radioactive materials such as radium 226, radium 228 and their daughter products. These radioactive elements usually stay with the water phase of production fluids and may either incorporate themselves in pipe scale or precipitate in sludges. Consequently, radioactive sludges and scales can build up within process equipment including pipes, tubes and other fluid handling vessels. With or without the presence of naturally occurring radioactive materials, it is desirable to clean the interior and exterior of oil production and transport tube and pipe from time to time. However, the residue or debris material which results from the cleaning operation presents certain disposal problems, particularly when it contains NORM.

The system 10 provides a unique apparatus 11 for handling and disposing of materials which are cleaned from oil field tube and pipe. Moreover, the system 10 includes certain features which advantageously improve the pipe or tube cleaning and handling process. Drawing FIGS. 1 and 2 illustrate an apparatus 11 which may be adapted for easy transport and setup in remote locations. In particular, as shown in FIGS. 1 and 2, the apparatus 11 of the system 10 includes an elongated, generally rectangular tub section 12 having opposed elongated sides 14 and 16, a bottom 17 and end walls 18 and 20.

The tub 12 is supported at spaced apart points by cross-beam members 19, one shown in FIG. 2, which, in turn, are connected to spaced apart upstanding columns 26 at opposite ends of the tub 12. The beams 19 may be adjusted in vertical height with respect to sub frame members 22 by suitable jack screws 24. The column members 26 extend above the tub 12 and are interconnected by transverse beams 28, as shown by way of example in FIG. 2. Suitable adjustable length tie rods 30 interconnect the tops of the column members 26 with the sub frame members 22.

As shown in FIG. 1, a longitudinal beam 32 extends between the beam members 28 and supports spaced apart hydraulic cylinder actuators 34. The actuators 34 are operably connected to a vertically moveable tub cover 38, having opposed longitudinal sidewalls 40 and 42, FIG. 2, endwalls 44 and 46 and a top wall 47. The endwall 46 is provided with a somewhat inverted U-shaped slot 50 which is at least partially closed by flexible seal means 52 having a vertical slit 54 formed therein for a purpose to be understood from further discussion hereinbelow. The tub cover 38 has a perimeter depending flange portion 60 extending along both longitudinal sides 40 and 42 and the endwalls 44 and 46 whereby, when the tub cover 38 is disposed in a lowered position, the flanges 60 fit inside the walls of the tub 12 to form a splash resistant closure to prevent liquid and other material from exiting the interior of the tub. FIG. 1 shows an alternate or open position with the cover 38 retracted above the tub 12 and FIG. 2 shows the cover 38 in the tub open position.

An elongated tube or pipe section 70 is shown suitably supported within an enclosed space 49 defined by the cover 38 and the tub 12 by spaced apart pairs of support rollers 72, each supported on a suitable frame 74. The pipe section 70 may be rotated by the rollers 72 which, as shown in FIG. 2, may be rotatably driven by a suitable hydraulic drive motor 77. The pipe section 70 may be moved into and out of the tub 12 by manual effort using spaced apart pipe support racks 80, FIGS. 1 and 2, but, preferably, pipe loading and unloading is assisted by a unique pipe handling mechanism to be described in further detail herein.

Figure 3:
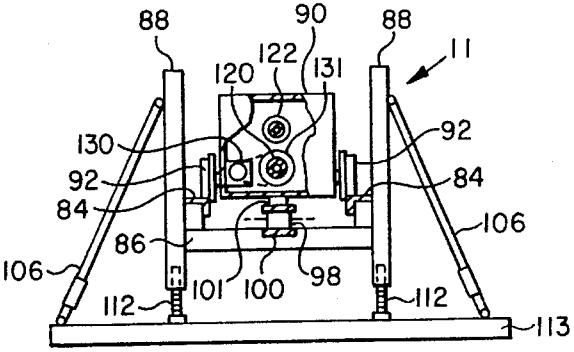
FIG. 3 is a section view taken generally from the line 3—3 of FIG. 1.

Referring further to FIG. 1 and also FIG. 3, the apparatus 11 includes a pair of spaced apart elongated rails 84, FIG. 3, suitably supported by frame means comprising plural spaced apart transverse beams 86, each of which are supported on generally parallel spaced apart column members 88. The rails 84 are adapted to support and guide a rotary drive head 90 having suitable support wheels 92 engageable with the rails 84. A drive mechanism comprising a pair of sprockets 98 and an endless drive chain 100 is disposed on the frame means supporting the rails 84. The drive chain 100 is operably connected to the drive head 90 at a bracket 101. A suitable drive motor 102 is drivably connected to one of the sprockets 98 for reversibly traversing the drive head 90 along the rails 84. As shown in FIG. 3, a preferred arrangement of the frame means for supporting the rails 84, which enhances the transportability of the system 10, includes suitable, adjustable length tie rods 106 interconnecting the columns 88 with sub frame beams 113. The position of the rails 84 may be adjusted by suitable jack screws 112 threadedly connected to the columns 88 and disposed on the beams 113. The joints between the beams and columns of the apparatus frame described herein may be bolted for easy assembly and disassembly.

Figure 4:
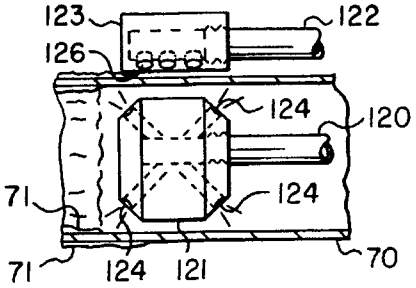
FIG. 4 is a detail view showing one embodiment of a tube cleaning nozzle head arrangement.

The drive head 90 is adapted to support one end of respective elongated tubular lances 120 and 122 which extend through the seal 52 into the interior space 49 of the tub 12, 38. The distal ends of the lances 120 and 122 are provided with hydraulic jet nozzle heads 121 and 123, respectively, see FIG. 4 also, each of which include respective jet nozzles 124 and 126 formed therein for directing a high-velocity stream of cleaning liquid within the interior of a pipe section 70, as shown, and along the exterior surface of the pipe section for cleaning the pipe section of scale and other debris or contaminants. As shown in FIG. 3, the drive head 90 is adapted to include a suitable rotation motor 130 which is drivably connected to the lance 120 through a drive sprocket 131. The lances 120 and 122 are also operably connected to respective high-pressure cleaning water and air supply conduits 132 and 133 whereby these cleaning fluids may be conducted through the lances to the nozzle head 121 and 123 for ejection on the surfaces of the pipe section 70 to clean scale 71, FIG. 4, from such surfaces, for example. The lance 122 is adapted to be non-rotatably supported by the drive head 90 so that the nozzles 126 are always directed onto the exterior surface of the pipe section 70. Since the pipe section 70 is rotated by the drive and support rollers 72, the entire exterior surface of the pipe section is also subject to a high-velocity stream of water or similar cleaning liquid ejected from the nozzle head 123 during a cleaning operation. As shown in FIG. 1, the lances 120 and 122 are supported intermediate their ends by spaced-apart traveling centralizers 135 which are suitably supported on the rails 84 for traversal therealong and to provide support for the relatively long, thin tubular lances.

Accordingly, when a section of tube or pipe 70 is disposed on the drive rollers 72, the lance 120 is extended into the pipe section and the nozzle head 121 is traversed forwardly, from right to left viewing FIG. 1, through the pipe section to effect cleaning of scale and debris which is then flushed into the tub 12. In this regard also, the fluid supply conduit 133 is connected to a source of high-pressure air so that during selected movement of the nozzle heads 121 and 123 from one end of the pipe section to the other, high-pressure air may be directed through the nozzles 124 and 126 to remove any liquid and scale which remains on or within the pipe section. Accordingly, upon withdrawal of the lances 120 and 122 from the pipe section 70, it has been substantially cleaned of scale, debris and cleaning liquid and is ready to be removed from the tub 12.

The material which is cleaned from the pipe section 70 is deposited in the tub 12 and flows through one or more discharge ports 140, FIG. 2, formed in the bottom wall 17. The scale and washwater and other debris flowing through the ports 140 may be subjected to a preliminary grinding or particle size reduction operation by motor driven rotary grinders 142, not unlike the types of grinders used as conventional kitchen garbage disposers. The reduced particle size scale and wash liquid are then conducted from the grinders 142 by way of a conduit 143 through a vacuum pump, not shown in FIG. 1, to a processing system which will be described in further detail herein.

Figure 6:
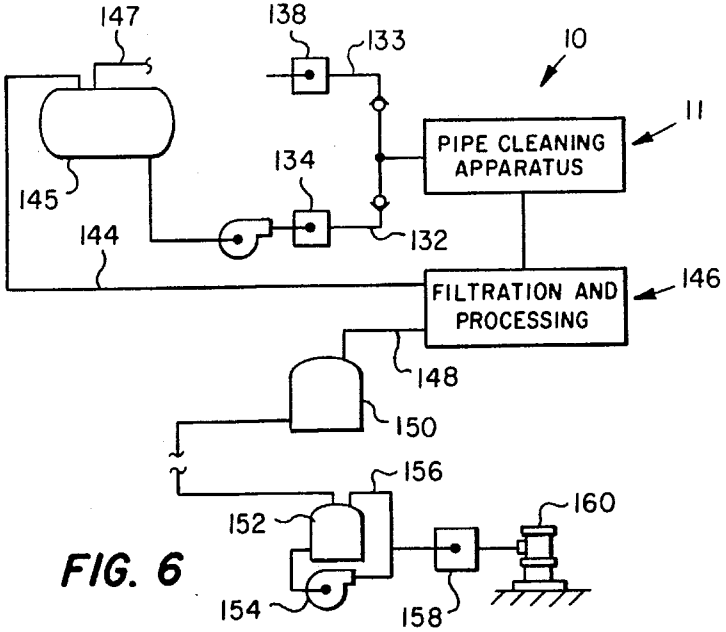
FIG. 6 is a schematic diagram illustrating certain features of the system.

Referring briefly to FIG. 6, there is illustrated a general schematic of the system 10 of the invention in a preferred arrangement which includes the pipe cleaning apparatus 11 which receives high-pressure cleaning liquid, such as water, by way of the conduit 132 and pressure air by way of the conduit 133. A pump 134 is operable to provide a suitably high pressure and flow rate of the cleaning water to the conduit 132. The pump 134 receives cleaning water from a charge pump 136 and high-pressure air is available to the conduit 133 by way of a compressor 138. The system 10 preferably includes a source of water comprising a tank 145 which may receive water from a suitable source by way of a conduit 147 and recycled water by way of a conduit 144 from a scale processing unit, generally designated by the numeral 146.

The filtration and processing unit 146 receives scale, debris and washing liquid from the conduit 143 and discharges relatively clean water to the conduit 144 and a slurry of relatively fine particle scale and liquid which is conducted by way of a conduit 148 to a holding tank 150. The slurry is conducted from the tank 150 to a further holding tank 152 in flow communication with a charge pump 154 which discharges to a recycling conduit 156 and to an injection pump 158 which is shown operably connected to a disposal well 160. Accordingly, a slurry of finely ground particles of scale, which may include NORM, may be conducted from the filtration and processing unit 146 to one or more storage tanks 150 and 152 for injection into a disposal well 160.

Figure 7:
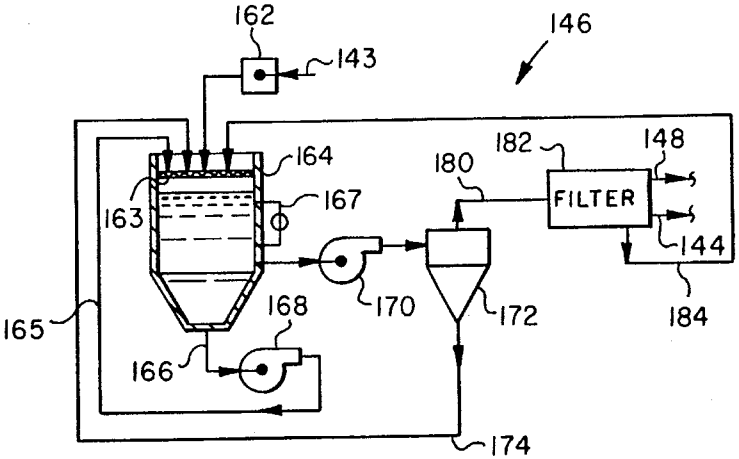
FIG. 7 is a schematic diagram of the particulate solids processing apparatus of the system.

Referring now to FIG. 7, the filtration and processing unit 146 includes a suitable vacuum pump 162 operably connected to the conduit 143 in such a way that the pressure within the washtub space 49, with the cover 38 closed, is at least slightly less than ambient atmospheric pressure to minimize the chance of discharge of washing liquid and scale from the tub 12 to the surrounding environment. The vacuum pump 162 discharges a mixture of washing liquid and scale and other debris onto a screen 163 and into a processing and holding tank 164 having a bottom discharge conduit 166 connected to a shearing pump 168. The particulate material discharged into the tank 164 may be reduced in particle size to a relatively fine ground material in accordance with the teaching of U.S. Pat. Nos. 5,109,933 and 5,129,469 to James L. Jackson and assigned to an assignee of the present invention. The discharge from the pump 168 is recirculated back to the tank 164 through a conduit 165 and the screen 163 which receives all of the flow into the tank to screen out extra-large particulates which cannot be processed by the unit 146. A suitable level control device 167 is operably associated with the tank 164 for controlling a pump 170 which draws slurry material away from the tank 164 and discharges same into a centrifugal or so-called cyclone type separator 172. Oversize solids separated from the slurry by the separator 172, in a particle size not less than about 80 microns, are recirculated back to the tank 164 by way of a conduit 174. A slurry of relatively fine solids is discharged from the separator 172 by way of a conduit 180 to a suitable particle filter 182. Oversized particles removed by the filter 182 that are in a particle size greater than about 10 microns may be returned to the tank 164 by way of a conduit 184 for further processing. At least part of the discharge flow from the filter 182 may be conducted back to the supply water tank 140 by way of conduit 144 and the remaining slurry of water and fine particulate solids, less than about 10 microns, may be conducted by way of conduit 148 to the storage tank 150, directly to the storage tank 152 or other suitable storage means or to the injection pump 158 for disposal in well 160.

Accordingly, the system 10 may be operated to clean scale from pipe sections, such as the pipe section 70, in a manner which minimizes the loss of cleaning liquid and debris and scale to the surrounding environment, provides for reducing the particle size of the debris and scale and preparation of a slurry which may be injected into a disposal well or other form of acceptable disposal. The system 10 may be operated on a substantially continuous basis to clean various tube and pipe sections which have an unusual or unacceptable build-up of scale and other debris material which could be considered a contaminant.

Figure 5:
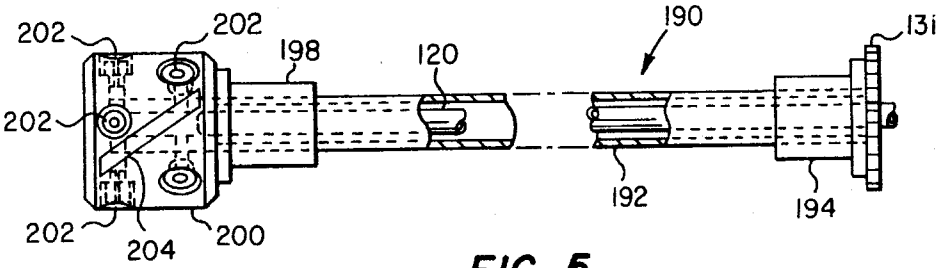
FIG. 5 is a detail view showing an alternate embodiment of a tube cleaning nozzle and cutting head arrangement.

Referring now to FIG. 5, there is illustrated an alternate embodiment of a lance and scale removal head for connection to the drive head 90. Certain pipe sections accumulate scale on the pipe interior surfaces which is too hard for water jet removal alone. Accordingly, for such applications, the lance and jet nozzle head shown and described in FIGS. 1 and 4 may be replaced by a lance and head assembly generally designated by the numeral 190 in FIG. 5. The lance and head assembly 190 includes a lance 120 with the nozzle head 121 removed and in its place a torque drive tube 192 is sleeved over the lance and suitably connected by way of a hub 194 to the drive sprocket 131 of the drive head 90. The opposite end of the drive tube 192 is connected to a hub 198 which is drivingly connected to a jet nozzle and mechanical cutting head 200.

The cutting head 200 is a generally cylindrical member which is suitably connected to the distal end of the lance 120 for receiving high-pressure cleaning fluids therefrom and for discharge against the interior surfaces of a tube section through plural, recessed jet nozzles 202 which are arranged in at least two rows wherein the nozzles are preferably spaced ninety degrees apart in each row and staggered from row to row at angles of 30 degrees to 45 degrees. The cutting head 200 also includes plural, circumferentially spaced apart, helical cutters 204, one shown, which may be formed of a hard material such as tungsten carbide which has been suitably deposited on the peripheral surface of the cylindrical cutting head to form cutting surfaces. The cutting head 200 and the helical cutters 204 are sized in accordance with the particular inner diameter of a piece of pipe or tube to be cleaned so that the cutting surfaces may engage and cut away scale or other hard debris which cannot be removed by the water jet action alone.

Moreover, the increased rotary drive effort required to effect mechanical cutting of scale from the interior surfaces of the pipe may be unsuitable for the small diameter of the lance 120 alone and a substantial amount of the torque transmitted from the drive sprocket 131 to the cutting head 200 is carried by the drive tube 192. In fact, the lance 120 may be replaced by a flexible conduit, not shown, wherein all of the drive torque is transmitted by the tube 192. Alternatively, the cutting head 200 may be drivenly connected to a rotary fluid operated motor, not shown, mounted on the distal end of tube 192 whereby the tube may be non-rotative and all driving torque exerted on the cutting head is provided by such a motor. Motive fluid, compressed air for example, could be conducted to such a motor through the annular space within the tube 192 while high-pressure cleaning liquid is conducted through the lance 120 or a suitable conduit to the head 200.

The modified jet nozzle and cutting head assembly illustrated in FIG. 5 also provides for conducting high-pressure water through the lance 120 to the head 200 for flow through suitable passages connected to the nozzles 202. As illustrated, the nozzles 202 are formed as inserts which may be threadedly connected to the head 200 and removed and replaced with nozzles of different size orifices or when erosion has enlarged a nozzle orifice. High-pressure air may also be conducted through the lance 120 for flow through the nozzles 202 in place of the cleaning liquid, when desired.

Figure 8:
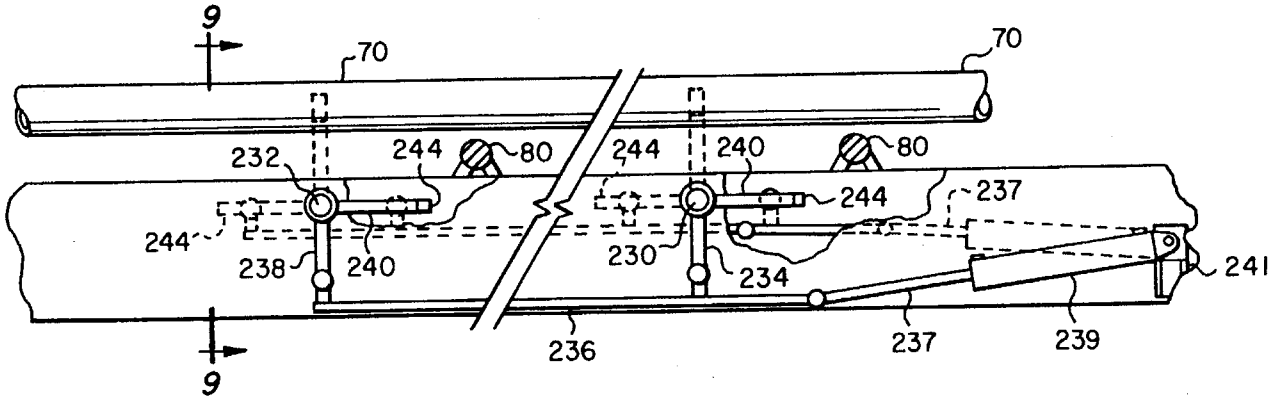
FIG. 8 is a detail view of the pipe handling mechanism.
Figure 9:
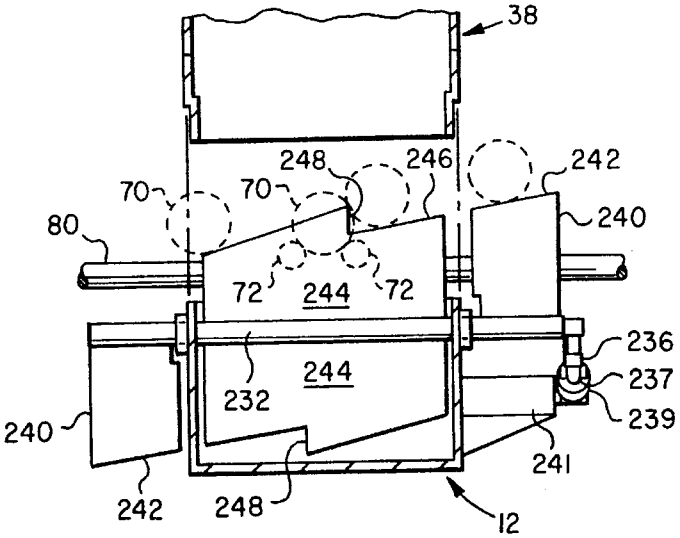
FIG. 9 is a section view taken along line 9—9 of FIG. 8.

A unique pipe handling mechanism is provided for placing tube or pipe sections in the tub 12 and for removing pipe sections from the tub. As shown and discussed with regard to FIGS. 1 and 2, the spaced apart pipe support racks 80 may be installed extending transversely of the longitudinal direction of the tub 12 and extending thereover. As shown in FIG. 1, the cover member 38 is suitably modified to provide pairs of opposed slots 224 and 226 which permit the cover to be moved between open and closed positions while clearing the racks 80. Suitable seal members may be disposed around the slots 224 and 226 to engage the racks 80 to minimize the chance of fluid and material being cleaned from the pipe to exit through the slots. Referring to FIGS. 8 and 9, the tub 12 also supports spaced apart rotatable shaft members 230 and 232 which are interconnected by linkage 234, 236 and 238 for causing the shaft members to rotate in unison. The piston rod 237 of a hydraulic cylinder type actuator 239 is connected to the link 236 for moving the shafts 230 and 232 between two working positions, to be described, and a retracted position. The actuator 239 is pivotally supported on a bracket 241 extending from one side of the tub 12, FIG. 9.

FIG. 9 illustrates, by way of example, the shaft 232 in a working position to remove a section of pipe 70 from the support rollers 72 for movement to the left, viewing FIG. 9, onto the racks 80 and for movement of another section of pipe from the racks 80 onto the support rollers. The shafts 230 and 232 each support two opposed pipe ramp members 240, each having an inclined surface 242 for engaging and lifting a section of pipe when disposed on the racks 80 and causing the section of pipe to roll onto second ramp members 244, each having a support surface 246 delimited by a stop 248. The second ramp members 244 are also supported by the shafts 230 and 232 within the tub 12 and aligned with the ramp members 240, respectively.

When a section of pipe 70, for example, is lifted off of the racks 80 by a set of ramp members 240, in response to rotation of the shafts 230, 232 to the position shown in FIG. 9, the ramp members 240 cause the pipe section to roll from right to left down the ramp surfaces 242 onto the surfaces 246 to be stopped somewhat off-center of the spaced apart rollers 72 by the surfaces 248 and a pipe section already supported on the rollers 72, as the case may be. With rotation of the shafts 230 and 232 to their upright positions, ramp members 244 may also lift a section of pipe from the support rollers 72 by inclined surfaces 256 which cause the pipe section previously supported by the rollers 72 to roll off of the surfaces 256 from right to left onto the pipe racks 80. When the shafts 230 and 232 are rotated back to their retracted positions shown in FIG. 8, the pipe section engaged with the surfaces 248 moves between and is lowered onto the rollers 72. In this way, when the cover 38 is in a raised position, pipe sections may be removed from the tub 12 and placed in the tub substantially simultaneously and automatically.

By providing opposed sets of ramp members 240 and 244 on each shaft member, pipe sections may be placed on the rollers 72 from the racks 80 in either direction, depending on which direction the actuator 239 is moved to place a set of ramp members 240 and 244 in a working position. For example, if a pipe section 70 has been moved out of the tub 12 to the left, viewing FIG. 9, and must be returned to the rollers 72, the ramp members 240 and 244, shown in the depending position in FIG. 9, may be rotated into a working position to roll the pipe back off the racks 80, from left to right, onto the rollers 72 for further cleaning, if needed.

The operation of the pipe cleaning system 10 shown and described is believed to be apparent to those of ordinary skill in the art from the foregoing description of the various features of the system. Suitable hydraulic controls may be placed at an operator control console, not shown, for operation of the cylinder actuators 34 and 239 and the drive motors 77, 102 and 130. Suitable remotely controllable valves, not shown, are also operable from the console to provide cleaning fluid to the lances 120 and 122, when required. When it is desired to effect removal of scale and other debris from a section of pipe 70, such pipe section is loaded onto the racks 80 and the cylinder actuator 239 is operated to effect movement of the pipe section to the stop position delimited by the surface 248. Retraction of the cylinder 239 to rotate the shafts 230 and 232 to the retracted positions of the ramp members 240 and 244 will effect movement of the aforementioned pipe section onto the sets of support and drive rollers 72. This operation is carried out with the cover 38 in the open position, of course.

After loading a pipe section 70 onto the drive and support rollers 72, the cover 38 is moved to the closed position and the drive head 90 is advanced to cause the lance and nozzle head assembly 120, 121 or 192, 200 to move into the pipe interior while the lance 122 simultaneously moves into position substantially over the top of the pipe. After the nozzle heads 121 or 200 are placed in the interior of the pipe section, they are rotated while pressure fluid such as high-pressure water is conducted to the nozzle heads 121 or 200 to effect hydroblast cleaning of the pipe interior while, simultaneously, high-pressure water is conducted through the lance 122 and the nozzle head 123 to clean the pipe exterior. The drive and support rollers 72 are rotatably driven to effect rotation of the pipe while the cleaning action occurs. Preferably the pipe is rotated in one direction while the lance 120 or 192 is rotated in the opposite direction to effect cutting of the material, if the nozzle head 200 is used, and hydraulic jet blasting of the material off of the interior of the pipe as well as off of the exterior of the pipe.

The drive head 90 is advanced until the lances 120 or 192 have caused their nozzle heads to extend completely through the pipe, from right to left, viewing FIG. 1, whereupon the direction of movement of the drive head 90 is reversed and high-pressure water may be replaced by high-pressure air through the nozzles of the heads 123 and 121 or 200 to effect further cleaning of scale and other debris which has remained loosely on or within the pipe. Multiple passes of the lances and nozzle heads may be carried out with discharge of high-pressure water if a single pass does not effect sufficient cleaning action. After cleaning is complete, the drive head 90 is retracted to remove the nozzle head from the interior of the pipe section being cleaned whereupon the cover 38 may be raised and the pipe handling mechanism previously described actuated to remove the pipe section that has just been cleaned while replacing it with another pipe section requiring cleaning.

The filtration and processing operation may be carried on simultaneously with operation of the pipe cleaning apparatus 11 by collection of the carrier water and scale and other debris in the tub 12 for flow through the grinders 142 and withdrawal to the collection and processing tank 164 by the pump 162. Treatment of the debris laden water may be continuously carried out by operation of the pumps 168, 170 and the separator 172 as well as the filter 182. Treated fines in the carrier water are then conducted to the storage tank 150 and at least a portion of the filtered water is returned to the supply tank 145 for use in the pipe cleaning operation.

Those skilled in the art will appreciate from the foregoing description that a unique cleaning system has been developed for sections of pipe and tube, particularly of the type used in oil and gas production operations. The system shown and described provides for complete containment of the material cleaned from the tubes and pipe and preparation of the material for conduction to an injection well for disposal into the earth whence the material came.

The various components of the system shown and described may be constructed using conventional engineering materials for devices which are typically exposed to corrosive fluids such as brine and similar materials. Such engineering materials are well known to those of ordinary skill in the art in the oil and gas production industry.

Although a preferred embodiment of a cleaning system in accordance with the present invention has been described in detail herein, those skilled in the art will also recognize that various substitutions and modifications may be made to the system, including its components, without departing from the scope and spirit of the appended claims.

What is claimed is:

1. A system for cleaning material from interior surface of a generally cylindrical pipe section comprising:

an elongated tub including a bottom section and a cover forming an enclosed space for containing said pipe section and material removed from said pipe section;

a support for supporting said pipe section within said tub;

a first elongated lance including a jet nozzle head connected to a distal end thereof for insertion within and traversal through said pipe section to effect cleaning of said material, including scale, from said interior surface of said pipe section;

a drive head connected to an end of said first lance opposite said nozzle head for traversing said first lance through the interior of said pipe section;

means for supplying high-pressure cleaning fluid to said first lance for discharge onto said pipe section to remove said scale and other debris therefrom;

a pump connected to said tub for withdrawing a slurry of cleaning fluid and particulate material from said tub; and particle size reducing means interposed between said tub and said pump for reducing the particle size of said scale.

2. The system set forth in claim 1 including:

a second elongated lance supported by said drive head and including a nozzle head connected to a distal end thereof for ejecting cleaning fluid onto an exterior surface of said pipe section.

3. The system set forth in claim 1 including:

a collection tank for receiving particulate material including said scale and cleaning fluid from said tub;

a particle size reducing device operably connected to said collection tank for reducing the particle size of said scale entrained with said cleaning fluid disposed in said tank.

4. The system set forth in claim 3 including:

a separator operably connected to said tank for receiving a slurry of particulate material and water comprising said cleaning liquid and for separating particulate material of a predetermined particle size from said slurry.

5. The system set forth in claim 4 including:

a filter connected to said separator for filtering further particulate material of a predetermined particle size from said slurry and a conduit for returning particulate material of a predetermined size to said collection tank.

6. The system set forth in claim 5 including:

a conduit connected to said filter for conducting a portion of slurry filtered by said filter for circulation to a storage tank, said storage tank being in fluid flow communication with said system for providing cleaning fluid thereto.

7. The system set forth in claim 1 wherein:

said cover is connected to power actuator means for moving said cover between an open position for receiving and discharging a pipe section with respect to said tub and a closed position for containing cleaning fluid and material cleaned from said pipe section.

8. The system set forth in claim 1 including:

particle size reduction means operably connected to said tub for receiving a slurry of particulate material and cleaning fluid from said tub for primary reduction in the particle size of said material.

9. The system set forth in claim 1 including:

pipe handling mechanism for removing a pipe section from said tub and for placing another pipe section in said tub, said mechanism including spaced apart ramp members movable between a retracted position and a working position for engaging a section of pipe disposed in said tub for removal therefrom, said ramp members including surfaces formed thereon for engaging a pipe section in said tub and moving said pipe section out of said tub in response to movement of said ramp members.

10. The system set forth in claim 9 wherein:

said ramp members include surfaces thereon for engaging another pipe section and moving said another pipe section into a position to be supported within said tub in response to movement of said ramp members.

11. The system set forth in claim 9 wherein:

said pipe handling mechanism includes spaced apart shafts supported by said tub and supporting said ramp members, respectively, and actuator means operably connected to said shafts for moving said shafts between working positions for engaging said pipe sections and retracted positions, respectively.

12. The system set forth in claim 1 wherein:

said nozzle head includes hard metal cutting surfaces formed thereon for engaging material adhering to the interior surfaces of said pipe section for removing said material during traversal of said nozzle head through said pipe section.

13. The system set forth in claim 1 wherein:

said lance includes an inner conductor tube for conducting pressure fluid therethrough to said nozzle head and an outer torque drive tube drivingly connected to said nozzle head and to means for rotating said lance and said nozzle head to transmit torque to said nozzle head.

14. The system set forth in claim 1 wherein:

said support for said pipe section includes spaced apart support rollers and a drive motor operably connected to said rollers for rotating said pipe section.

15. A system for cleaning scale from a generally cylindrical pipe section comprising:

an elongated tub including a bottom section and a cover forming an enclosed space for containing said pipe section and material removed form said pipe section;

a support for supporting said pipe section within said tub;

means for supplying high-pressure cleaning liquid to said space for discharge onto said pipe section to remove said scale therefrom;

a collection tank for receiving particulate material including said scale and cleaning liquid from said tub; and a particle size reducing device operably connected to said collection tank for reducing the particle size of said scale entrained with said cleaning liquid disposed in said tank.

16. The system set forth in claim 15 including:

a separator operably connected to said tank for receiving a slurry of particulate material and said cleaning liquid and for separating particulate material of a predetermined particle size from said slurry.

17. The system set forth in claim 16 including:

a filter connected to said separator for filtering further particulate material of a predetermined particle size from said slurry and a conduit for returning particulate material of a predetermined size to said collection tank.

18. A system for cleaning material from a generally cylindrical pipe section comprising:

an elonated tub including a bottom section and a cover forming an enclosed space for containing said pipe section and material removed from said pipe section;

a support for supporting said pipe section within said tub;

a pump connected to said tub for withdrawing a slurry of cleaning liquid and particulate material including scale from said tub;

particle size reduction means operably connected to said tub for receiving a slurry of particulate material and cleaning liquid from said tub for primary reduction in the particle size of said material; and power actuator means for moving said cover between an open position for receiving and discharging a pipe section with respect to said tub and closed position for containing cleaning liquid and material cleaned from said pipe secton.

19. The system set forth in claim 18 including:

pipe handling mechanism for removing a pipe section from said tub and for placing another pipe section in said tub, said mechanism including spaced apart ramp members movable between a retracted position and a working position for engaging a section of pipe disposed in said tub for removal therefrom, said ramp members including surfaces formed thereon for engaging a pipe section in said tub and moving said pipe section out of said tub in response to movement of said ramp members.

20. The system set forth in claim 19 wherein:

said pipe handling mechanism includes spaced apart shafts supported by said tub and supporting said ramp members, respectively, and actuator means operably connected to said shafts for moving said shafts between working positions for engaging said pipe sections and retracted positions, respectively.

21. The system set forth in claim 19 wherein:

said ramp members include surfaces thereon for engaging another pipe section and moving said another pipe section into a position to be supported within said tub in response to movement of said ramp members.

* * * * *